US005261841A

United States Patent [19]

Imaeda

[11] Patent Number: 5,261,841

[45] Date of Patent: Nov. 16, 1993

[54] CONTROL FOR JET PROPULSION UNIT OF WATERCRAFT

[75] Inventor: Hirofumi Imaeda, Iwata, Japan

[73] Assignee: Yamaha Hatsudoki Kabushiki Kaisha, Iwata, Japan

[21] Appl. No.: 830,726

[22] Filed: Feb. 4, 1992

[30] Foreign Application Priority Data

Feb. 8, 1991 [JP] Japan ..... 3-17485

[51] Int. Cl.[5] ..... B63N 11/08

[52] U.S. Cl. ..... 440/53; 114/270; 440/61

[58] Field of Search ..... 440/38, 47, 53, 61-63; 114/270; 200/516

[56] References Cited

U.S. PATENT DOCUMENTS 3,434,449 3/1969 North ..... 440/61
4,280,633 7/1981 Boros ..... 114/211
4,924,046 5/1990 Howard ..... 200/516
4,934,969 6/1990 Kuragaki ..... 440/1

FOREIGN PATENT DOCUMENTS 2732671 2/1979 Fed. Rep. of Germany ..... 440/38
0014789 1/1991 Japan ..... 440/38

*Primary Examiner*—Edwin L. Swinehart
*Attorney, Agent, or Firm*—Ernest A. Beutler

[57] ABSTRACT

A watercraft having a jet propulsion unit that is supported at least in part within a tunnel on the under side of the hull and which is movable between a driving position and a service position. The control for operating the jet propulsion unit to move it between its positions is disposed within the tunnel and accessible through a service opening so that it cannot be accidentally actuated.

26 Claims, 4 Drawing Sheets

CONTROL FOR JET PROPULSION UNIT OF WATERCRAFT

BACKGROUND OF THE INVENTION

This invention relates to a control for the jet propulsion unit of a watercraft and more particularly to a control for controlling the movement of a jet propulsion unit or a portion of it in a watercraft.

Jet propelled watercraft are a very popular form of watercraft due to the numerous advantages of jet propulsion units over propeller type propulsion devices. If the jet propulsion unit is positioned at least in substantial part in a tunnel formed in the under side of the hull of the watercraft, then the watercraft can not only enjoy the benefits of jet propulsion units but also can have very neat and compact assembly. However, there are some advantages in having either the jet propulsion unit or at least a portion of it movable for a variety of reasons, for example, so as to raise the water inlet opening of the jet propulsion unit out of the body of water in which it is operating either for storage or service. The co-pending application entitled, "Water Jet Propulsion Unit," Ser. No. 735,154, filed Jul. 22, 1991 in the name of Noboru Kobayashi, which application is a continuation of application Ser. No. 489,361 filed Mar. 6, 1990 and now abandoned, which applications are assigned to the assignee hereof, disclose a number of embodiments of jet propulsion units that are mounted within the hull of the watercraft and which are movable for servicing purposes.

In connection with the movement of the jet propulsion unit, it is frequently desirable to employ some type of power device for effecting the movement. The controls for such power devices have been positioned in proximity to the operator's station in the watercraft. Although such positioning of the controls has some advantages, it also has certain disadvantages. If the control is activated accidentally, then the jet propulsion unit can be moved at a time when it is propelling the watercraft and this may not be desirable.

It is, therefore, a principal object of this invention to provide an improved control for a jet propulsion unit of a watercraft.

It is another object of this invention to provide a jet propulsion unit control that is easily accessible but cannot be accidentally operated.

SUMMARY OF THE INVENTION

This invention is adapted to be embodied in a jet propelled watercraft having a hull defining a tunnel. A jet propulsion unit is provided and is supported with at least a portion of the jet propulsion unit at least in part in the tunnel for movement between a lowered drive position and a raised position. Power means are provided for moving the jet propulsion unit between its positions. The hull has a wall member with an opening therein which communicates with the interior of the tunnel and control means are positioned within the tunnel and accessible through the opening for operating the power means.

Another embodiment of this invention is adapted to be embodied in a jet propelled watercraft having a hull defining a tunnel and a passenger compartment with a control area, a jet propulsion unit is provided and is supported with at least a portion of the jet propulsion unit at least in part in the tunnel for movement between a lowered drive position and a raised position. Power means are provided for moving the jet propulsion unit between its positions. The hull has a wall member with an opening therein that communicates with the interior of the tunnel and through which the jet propulsion unit may be accessed. In accordance with this feature of the invention, control means are positioned contiguous to the opening and remotely from the control area for operating the power means.

DETAILED DESCRIPTION OF THE PREFERRED EMBODIMENT OF THE INVENTION

Figure 1:
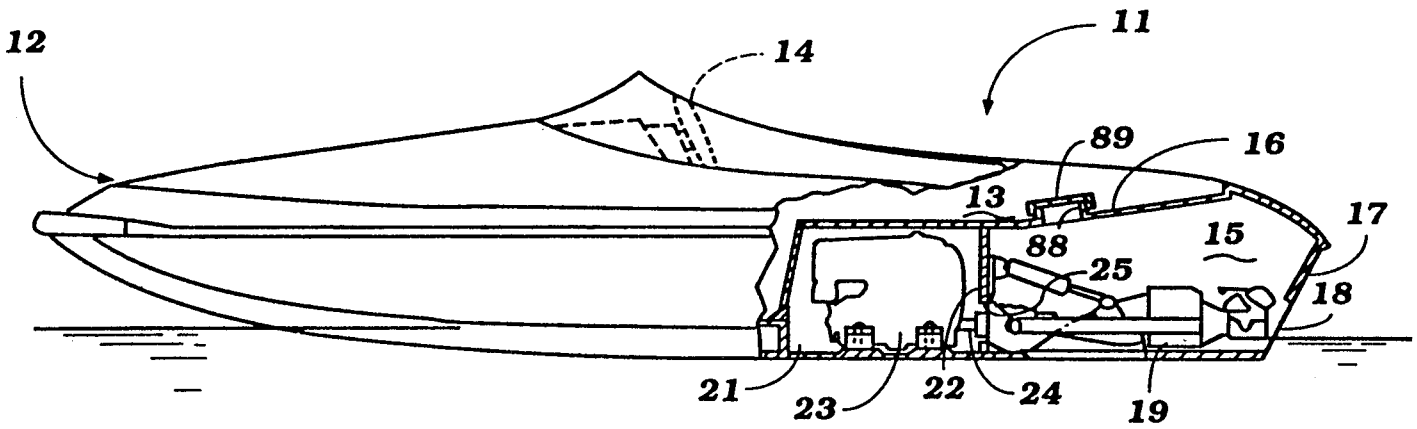
FIG. 1 is a side elevational view of a watercraft propelled by a jet propulsion unit constructed in accordance with an embodiment of the invention and shown in its operating condition in a body of water, with a portion broken away.

Referring first in detail to FIG. 1, a jet propelled watercraft constructed in accordance with an embodiment of the invention is identified generally by the reference numeral 11. The watercraft 11 has a hull assembly, indicated generally by the reference numeral 12 and which may have any known construction. The hull 12 defines a rider's and/or passenger's compartment 13 toward the rear portion of the hull 12 and in which a control area 14 is provided that offers access for the various controls of the watercraft such as its steering, throttle, reverse operation, etc.

A tunnel 15 is formed at the rear portion of the hull 12 on its under side and at the rear portion of the rider's compartment 13. The tunnel 15 is defined by a generally horizontally extending upper surface 16 and a transom 17 having a partial opening 18 at the rear portion thereof, for a reason to be described. A jet propulsion unit, indicated generally by the reference numeral 19, is supported within the tunnel 15 and is movable, as will be described, from a lowered driving position as shown in FIG. 1 and in the solid line view of FIG. 2 to an elevated storage or service position as shown in the phantom line view of FIG. 2.

An engine compartment 21 is formed forwardly of the tunnel 15 and is divided therefrom by a bulkhead 22. A powering internal combustion engine 23 is positioned in the engine compartment 21 and has an output shaft 24 that is rotatable about a longitudinally extending axis and which extends through an opening 25 in the bulkhead 22 for driving the jet propulsion unit 19 in a manner now to be described by particular reference to FIGS. 2 and 3.

Jet propulsion unit 19 is comprised of an outer housing which includes a water inlet portion 26 that has an inlet duct 27 which extends from an inlet opening defined by an outwardly extending flange 28 and across which a screen 29 is provided for preventing the ingestion of large foreign objects. The screen 29 is disposed at an angle so that it does not extend downwardly below the bottom of the hull 12 but tapers toward its rear edge so that any foreign material which may become lodged in the screen can easily flow backward along the length of the screen 29 and be discharged along the under side of the hull 12.

The water inlet portion 26 has a further flange 31 to which a corresponding flange 32 of an impeller housing 33 is affixed with interposed gaskets and spacer plates 34. The rear portion of the impeller housing 33 is provided with a plurality of straightening vanes 35 which extend from a nacelle 36. The nacelle 36 forms a rear bearing support for an impeller shaft 37 with an impeller 38 being affixed to this impeller shaft 37 forwardly of the nacelle 36 and straightening vanes 35. The impeller shaft 36 and impeller 38 are driven from the engine 23 in a manner to be described and this action draws water through the inlet passage way 27.

The impeller housing 33 has a cylindrical outer portion that is journaled in a bushing 39 that is carried by a support assembly comprised of first and second plates 41 and 42 that are fixed to each other in a suitable manner. A discharge nozzle 43 is affixed to the support plate 42 and receives water that is driven past the straightening vanes 35 by the impeller 38. A steering nozzle 44 is pivotally supported by means of pivot pins 45 for steering movement about a vertically extending axis at the end of the discharge nozzle 43. The steering nozzle 44 is coupled for steering movement to the controls 14 by means of a bowden wire actuator 46.

A reverse thrust bucket 47 is pivotally supported on the steering nozzle 44 by means of a pair of aligned pivot pins 48. An actuating lever 49 is also pivotally supported on the steering nozzle 44 by means of respective pivot pins 51 and has a pin and slot connection to the reverse thrust bucket 47 for moving it from a forward drive position as shown in solid lines in FIG. 2 to a reverse thrust position as shown in phantom lines in this figure. A bowden wire actuator 52 is connected to the actuating lever 49 for effecting this movement of the reverse thrust bucket 47.

The jet propulsion unit 19 is supported as a unit within the tunnel 15 by means of a cradle assembly, indicated generally by the reference numeral 53. The cradle assembly 53 has an upstanding forward portion 54 that is affixed to the bulkhead 22 on the tunnel side thereof. A horizontally extending portion 55 extends rearwardly from the upstanding portion 54 and underlies at least in part the jet propulsion unit 19. This horizontally extending part has an upwardly extending surface that terminates in a downwardly inclined flange 56 that defines a water inlet opening 57 which is, in turn, aligned with the inlet opening 27 of the jet propulsion unit 19 when the jet propulsion unit is in its normal driving position.

The impeller shaft 37 extends forwardly through a pilot portion 58 of the water inlet portion 56. A bearing and seal assembly 59 is inserted into the pilot portion 58 and journals the forward end of the impeller shaft 37. A universal joint assembly, indicated generally by the reference numeral 61, has a splined connection to the forward end of the impeller shaft 37 and a splined connection to a coupling 62 which is, in turn, affixed to the engine output shaft 24 so as to provide a driving connection between the engine 23 and the impeller 38, which connection is also pivotal about an axis now to be described.

The pilot bearing member 59 has a pair of forwardly extending arms 62 that have a pivotal connection to a pair of rearwardly extending arms 63 of a trunnion 64 formed integrally with the upstanding cradle portion 54. A pair of aligned pivot pins 65 form this pivotal connection and this pivotal connection is coincident with a pivot axis of the universal joint 61.

A pair of support arms 66 are disposed on opposite sides of the jet propulsion unit 19 and have pivotal connections at their forward ends to upstanding side walls 67 of the cradle assembly 53 by means of pivot pins 68. This pivotal connection is also aligned with the pivotal connection provided by the pivot pins 65 and the universal joint 61. The rear ends of the support arms 66 are affixed to bearing blocks 69 which are in turn affixed to the support rings 41 and 42.

A pair of hydraulic cylinders 71 have their cylinder portions pivotally connected to trunnions 72 of the support cradle portion 54 by means of pivot bolts 73. The rods of the hydraulic cylinders 71 are connected by means of pivot pins 74 to upstanding portions 75 of the support arms 66.

Figure 2:
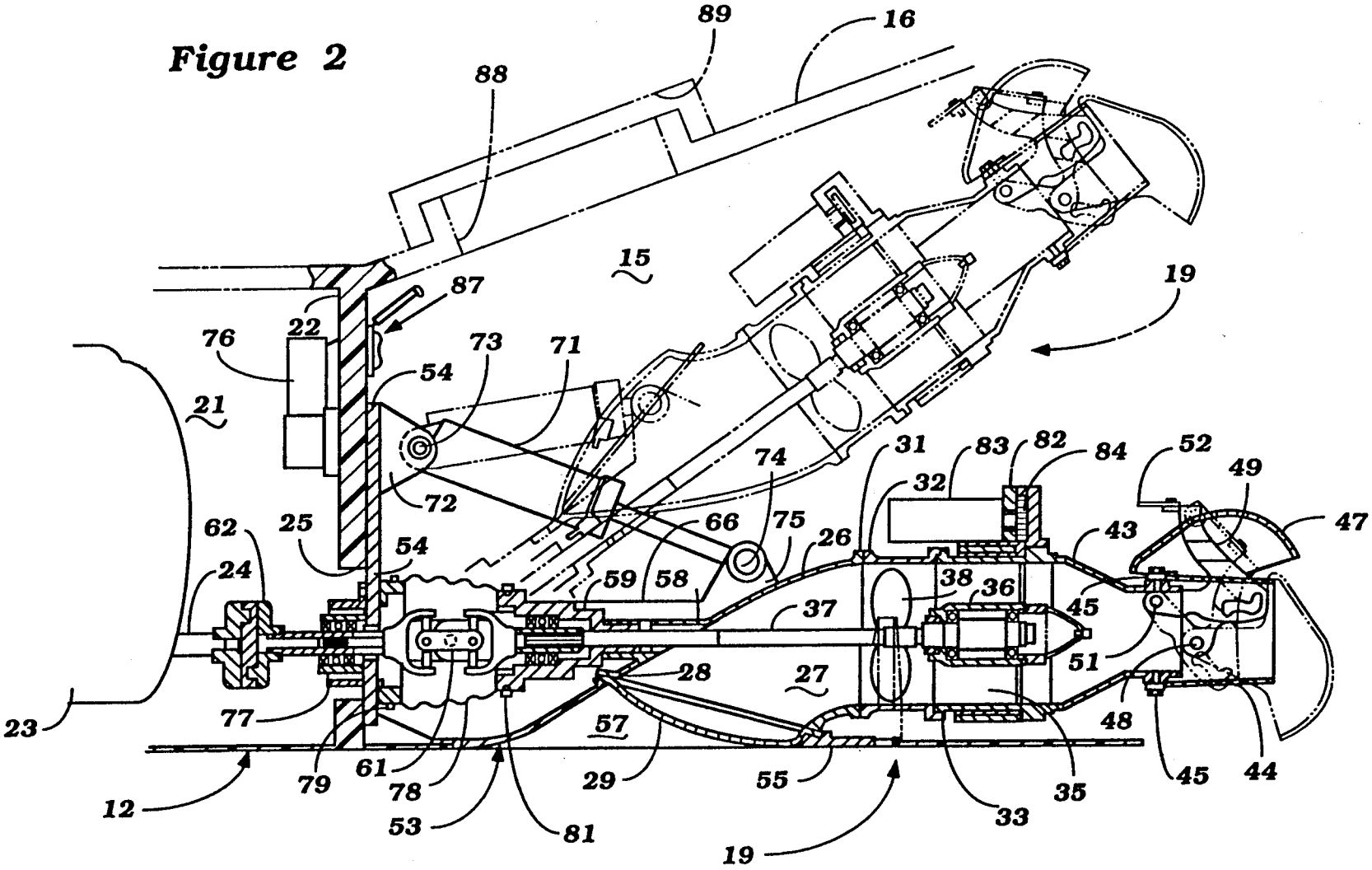
FIG. 2 is an enlarged cross-sectional view of the broken away area depicted in FIG. 1 and shows the construction of the jet propulsion unit and its association with the watercraft.
Figure 3:
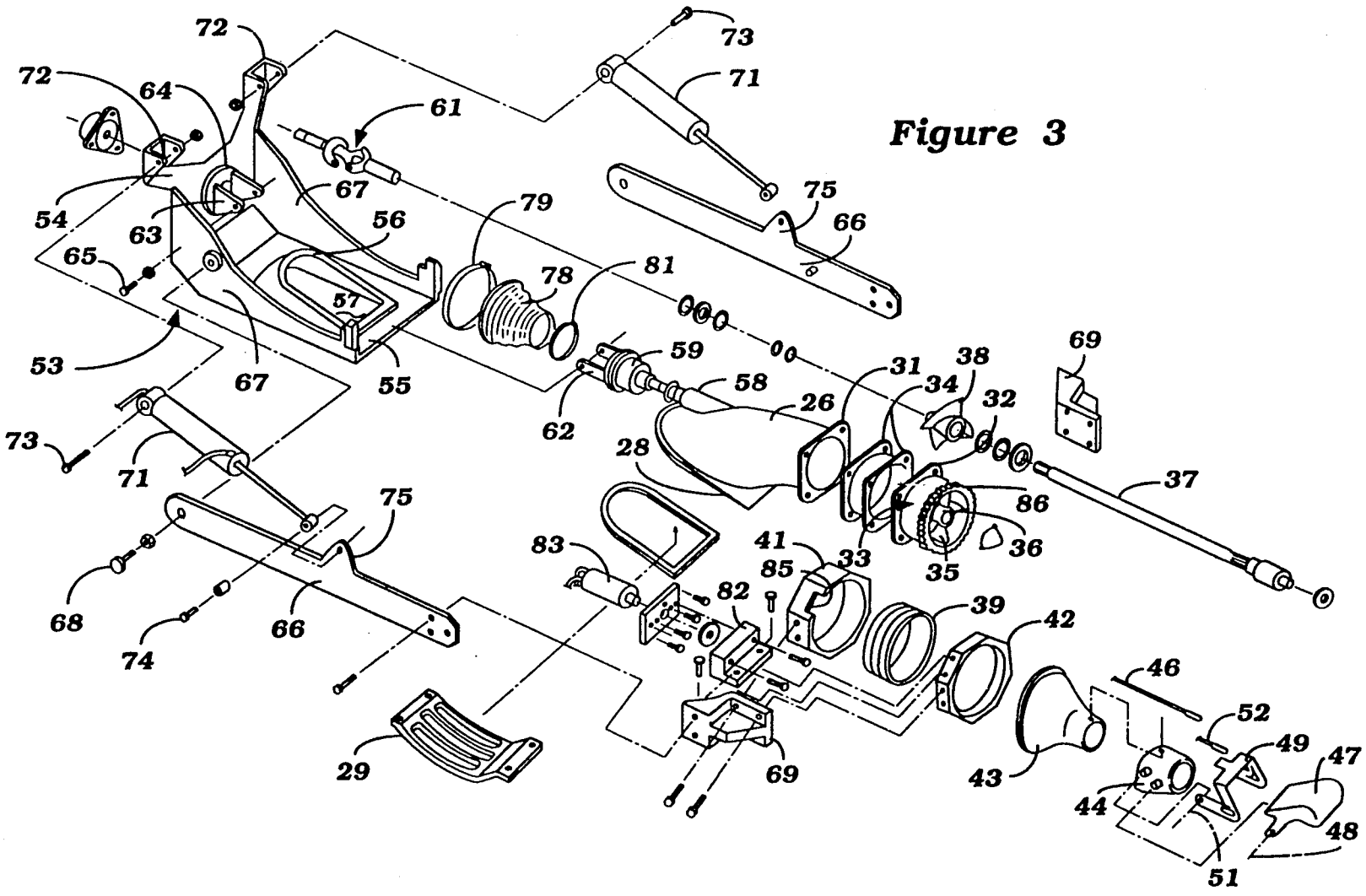
FIG. 3 is an exploded perspective view of the jet propulsion unit.

A reversible electric motor hydraulic pump assembly 76 is mounted on the engine compartment side of the bulkhead 22 and supplies hydraulic fluid to actuate the hydraulic cylinders 71 so as to pivot the jet propulsion unit 19 about the transverse horizontally disposed pivot axis defined by the pivot pins 63, 68 and universal joint 61 between a lowered normal driving position and an elevated out-of-the-water service position as shown in FIG. 2. The control for this movement will be described later.

A sealing and bearing assembly 77 is affixed to the forward side of the cradle portion 54 for journaling the coupling 62 and forward portion of the universal joint 66.

An elastic boot 78 encircles the universal joint 61 and is affixed to the trunnion portion 64 of the cradle assembly by a first clamp 79 and to the bearing block 59 by a second clamp 81. The flexible boot 78 provides sealing around the universal joint 61, accommodates the aforenoted pivotal movement about the transversely extending horizontal pivotal axis and also permits rotation of the water inlet portion 26 and impeller housing portion 33 of the jet propulsion unit 19, which is accomplished in a manner now to be described.

A supporting block 82 is affixed to the support ring 41 and, in turn, carries a reversible electric motor 83. The reversible electric motor 83 has an output shaft to which a gear 84 is affixed and which gear extends through a notch or recess 85 in the support ring 41. The gear 84 meshes with a gear 86 formed integrally on the impeller housing 33. When the electric motor 83 is operated, the water inlet portion 26 and impeller housing 33 will rotate in the bushing 39 from a downwardly facing normal position to an upwardly facing service position as shown in phantom in FIG. 2.

It is desirable to ensure that the rotation of the water inlet portion 26 does not occur until after the jet propulsion unit 19 has been pivoted away from contact with the surface 56 and also that the water inlet portion 26 is rotated to its downwardly facing position before the jet propulsion unit 19 is lowered to its driving position. Any suitable type of control arrangement may be incorporated for this purpose.

Thus, the way the system operates is that when it is desired to elevate the jet propulsion unit 19 and have the water inlet portion 26 rotated upwardly, a switch, to be described, is actuated. Then the reversible motor 76 is operated so as to energize the cylinders 71 and at least begin pivotal movement of the jet propulsion unit 19 about the transversely disposed horizontal axis. Once the flange 28 of the water inlet portion 26 is clear of the surface 56 of the supporting cradle 53, then the electric motor 83 may be energized so as to rotate the water inlet portion 26 and impeller portion 33 from their downwardly facing position to an upwardly facing position. This may be done either after the pivotal movement about the horizontal transverse axis is completed or while this motion is being continued.

When it is desired to return the jet propulsion 19 from its storage position as shown in the phantom line view of FIG. 2 to its driving position, the switch is again actuated. When this occurs, the motor 83 is first energized to rotate the water inlet portion 26 and impeller portion 33 to their downwardly facing positions and actuate the cylinder 71 so as to lower the jet propulsion unit 19. The timing of this sequencing may be as desired, however, it is important to ensure that the water inlet portion 26 is in its downwardly facing position before the jet propulsion unit 19 is fully lowered into engagement with the surface 56.

Heretofore it has been the practice to provide the control for operating the hydraulic cylinder 71 and electric motor 83 in the rider's compartment 13 in proximity to the controls 14. However, this may give rise to accidental energization of the system which is undesirable.

Figure 4:
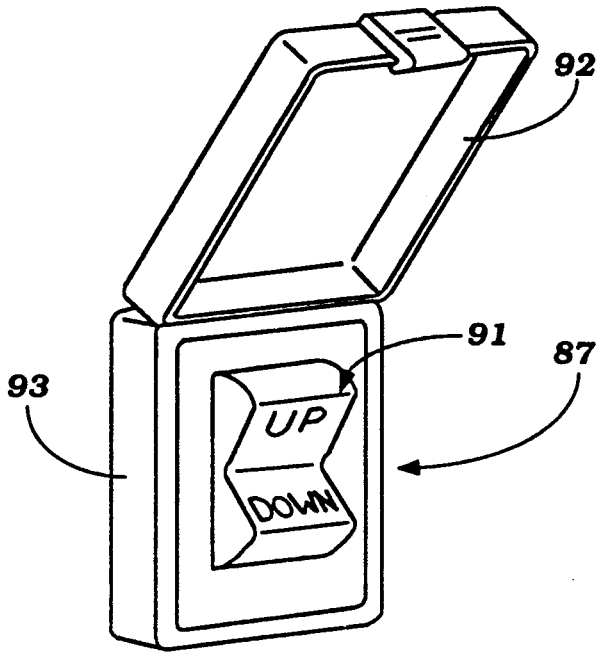
FIG. 4 is an enlarged perspective view showing the control for the device for moving the jet propulsion unit.
Figure 5:
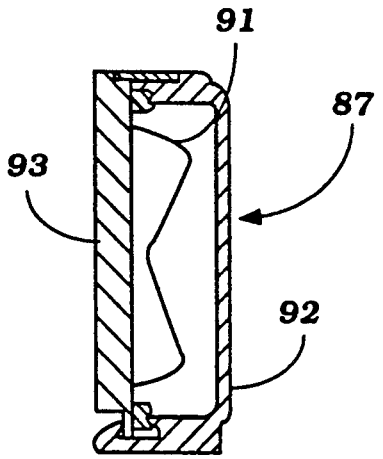
FIG. 5 is a cross-sectional view taken through the control with its protective cover being shown in a closed position.

In accordance with the invention, therefore, a control switch, indicated generally by the reference numeral 87 and shown in most detail in FIGS. 2, 4 and 5, is provided which is mounted in the tunnel 15. It should be noted that the hull wall 16 is provided with an access opening 88 that is closed by a removable closure 89 and which is juxtaposed to the screen 29 and water inlet opening 27 when the jet propulsion unit 19 is in its elevated storage, service position. The switch 87 is mounted on the bulkhead 22 in proximity to the opening 88 so that it may be easily activated by an operator from the rider's compartment 13 upon removal of the closure 89 and reaching through the opening 88.

In the illustrated embodiment, the switch 87 comprises a toggle switch 91 which has only an up and a down position and which is normally protected by a pivotally supported closure 92 carried at the top of a mounting portion 93 of the control 87. FIG. 4 shows the arrangement when the closure 92 is in its opened position. Hence, the control 87 is readily accessible when servicing is desired and yet is out of the way and cannot be accidentally actuated from the control position. Although the illustrated embodiment shows the switch 87 as being mounted on the bulkhead 22, it may be mounted anywhere in the tunnel 15 or at the mouth of the opening 88.

Since the opening 88 is positioned at a substantial distance from the control area, it would also be possible to provide the switch 87 on the outside of the tunnel 15 adjacent the opening 88 so that an operator could operate it while viewing the jet propulsion unit 19 through the opening 88. Such a remote location would ensure that an operator in the control area 14 could not inadvertently actuate the switch 87. Although it is possible to delete the use of the cover member 92 when the switch 87 is mounted in the tunnel 15, it is desirable to retain the cover member 92 if the switch is mounted within the hull adjacent the opening so as to further ensure against accidental operation. Various other changes and modifications may be made without departing from the spirit and scope of the invention, as defined by the appended claims.

I claim:

1. A jet propelled watercraft having a hull defining a tunnel, a jet propulsion unit, means supporting at least a portion of said jet propulsion unit at least in part in said tunnel for movement between a lowered drive position and a raised position, power means controlled solely by a manually actuated switch for moving said jet propulsion unit between said positions, said hull having a wall member with an opening therein communicating with the interior of said tunnel, and said manually actuated switch positioned within said tunnel and accessible through said opening for controlling the operation of said power means.

2. A jet propelled watercraft as set forth in claim 1 wherein the jet propulsion unit has a water inlet portion defining a water inlet opening through which water for the jet propulsion unit is drawn from the body of water in which the watercraft is operating.

3. A jet propelled watercraft as set forth in claim 2 wherein the water inlet opening portion of the jet propulsion unit is supported for movement about a transversely extending horizontally disposed pivot axis.

4. A jet propelled watercraft as set forth in claim 2 wherein the water inlet opening portion of the jet propulsion unit is supported for rotation about a generally longitudinally extending horizontal axis.

5. A jet propelled watercraft as set forth in claim 4 wherein the water inlet opening portion of the jet propulsion unit is also supported for movement about a transversely extending horizontally disposed pivot axis.

6. A jet propelled watercraft as set forth in claim 1 wherein the power means includes components that are disposed externally of the tunnel.

7. A jet propelled watercraft as set forth in claim 6 wherein the components disposed externally of the tunnel are controlled by the switch.

8. A jet propelled watercraft as set forth in claim 7 wherein the jet propulsion unit has a water inlet portion defining a water inlet opening through which water for the jet propulsion unit is drawn from the body of water in which the watercraft is operating.

9. A jet propelled watercraft as set forth in claim 8 wherein the water inlet opening portion of the jet propulsion unit is supported for movement about a transversely extending horizontally disposed pivot axis.

10. A jet propelled watercraft as set forth in claim 8 wherein the water inlet opening portion of the jet propulsion unit is supported for rotation about a generally longitudinally extending horizontal axis.

11. A jet propelled watercraft as set forth in claim 10 wherein the water inlet opening portion of the jet propulsion unit is also supported for movement about a transversely extending horizontally disposed pivot axis.

12. A jet propelled watercraft as set forth in claim 11 wherein the opening is disposed in an upper wall of the hull defining the tunnel.

13. A jet propelled watercraft as set forth in claim 1 wherein the opening is disposed in an upper wall of the hull defining the tunnel.

14. A jet propelled watercraft as set forth in claim 1 wherein the power means comprises an electrical motor operated by the switch.

15. A jet propelled watercraft as set forth in claim 14 wherein the power means further includes a reversible hydraulic pump driven by said electrical motor.

16. A jet propelled watercraft having a hull defining a rider's area with a control position and tunnel, a jet propulsion unit, means supporting at least a portion of said jet propulsion unit at least in part in said tunnel for movement between a lowered drive position and a raised position, power means controlled solely by a manually actuated switch for moving said jet propulsion unit between said positions, said hull having a wall member with an opening therein communicating with the interior of said tunnel and remotely from said control position, and said manually actuated switch positioned contiguous to said opening and at a place which can not be reached by an operator at said control position for controlling the operation of said power means.

17. A jet propelled watercraft as set forth in claim 16 wherein the jet propulsion unit has a water inlet portion defining a water inlet opening through which water for the jet propulsion unit is drawn from the body of water in which the watercraft is operating.

18. A jet propelled watercraft as set forth in claim 17 wherein the water inlet opening portion of the jet propulsion unit is supported for movement about a transversely extending horizontally disposed pivot axis.

19. A jet propelled watercraft as set forth in claim 17 wherein the water inlet opening portion of the jet propulsion unit is supported for rotation about a generally longitudinally extending horizontal axis.

20. A jet propelled watercraft as set forth in claim 19 wherein the water inlet opening portion of the jet propulsion unit is also supported for movement about a transversely extending horizontally disposed pivot axis.

21. A jet propelled watercraft as set forth in claim 16 wherein the power means includes components that are disposed externally of the tunnel.

22. A jet propelled watercraft as set forth in claim 21 wherein the opening is disposed in an upper wall of the hull defining the tunnel.

23. A jet propelled watercraft as set forth in claim 16 wherein the opening is disposed in an upper wall of the hull defining the tunnel.

24. A jet propelled watercraft as set forth in claim 16 further including a removable cover member for enclosing the switch to further protect against accidental operation.

25. A jet propelled watercraft as set forth in claim 16 wherein the power means comprises an electrical motor operated by the switch.

26. A jet propelled watercraft as set forth in claim 25 wherein the power means further includes a reversible hydraulic pump driven by said electrical motor.

* * * * *